US010614749B2

(12) United States Patent
Kim et al.

(10) Patent No.: US 10,614,749 B2
(45) Date of Patent: Apr. 7, 2020

(54) SOURCE DRIVER UNIT FOR A DISPLAY PANEL

(71) Applicant: MagnaChip Semiconductor, Ltd., Cheongju-si (KR)

(72) Inventors: Hyoung Kyu Kim, Cheongju-si (KR); Won Seok Lee, Yongin-si (KR); Jin Seok Yang, Cheongju-si (KR); Dae Young Yoo, Sejong-si (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 38 days.

(21) Appl. No.: 15/891,621

(22) Filed: Feb. 8, 2018

(65) Prior Publication Data

US 2018/0286305 A1 Oct. 4, 2018

(30) Foreign Application Priority Data

Mar. 29, 2017 (KR) ..... 10-2017-0040258

(51) Int. Cl.

| | |
|---|---|
| ***G09G 3/20*** | (2006.01) |
| ***G09G 3/30*** | (2006.01) |
| ***G09G 3/36*** | (2006.01) |
| ***G09G 3/3275*** | (2016.01) |

(52) U.S. Cl.

CPC ..... *G09G 3/30* (2013.01); *G09G 3/2074* (2013.01); *G09G 3/3275* (2013.01); *G09G 3/3685* (2013.01); *G09G 2310/0264* (2013.01); *G09G 2310/0275* (2013.01); *G09G 2310/0291* (2013.01); *G09G 2310/066* (2013.01); *G09G 2320/0223* (2013.01); *G09G 2330/021* (2013.01); *G09G 2360/16* (2013.01)

(58) Field of Classification Search

CPC ... G09G 2310/0264; G09G 2310/0275; G09G 2310/0291; G09G 2310/066; G09G 2320/0223; G09G 2330/021; G09G 2360/16; G09G 3/2074; G09G 3/30; G09G 3/3275; G09G 3/3685

See application file for complete search history.

(56) References Cited

U.S. PATENT DOCUMENTS

2004/0036670 A1* 2/2004 Chung ..... G09G 3/3688 345/99
2013/0113848 A1* 5/2013 Bae ..... G09G 3/3688 345/691
2013/0286002 A1* 10/2013 Huang ..... G09G 3/3611 345/213
2013/0307838 A1* 11/2013 Kim ..... G09G 5/001 345/212

(Continued)

*Primary Examiner* — Hong Zhou
(74) *Attorney, Agent, or Firm* — NSIP Law

(57) ABSTRACT

A source driver apparatus for a display panel includes source drivers and a slew rate controller. Each of the source drivers includes a data latch, a decoder, and an output buffer. The data latch is configured to hold sub-pixel data. The decoder is configured to decode the sub-pixel data held in the data latch to provide a driving signal. The output buffer has an adjustable slew rate and is configured to buffer the driving signal to provide a buffered driving signal. The slew rate controller is configured to analyze the sub-pixel data in the data latch in each of the source drivers and dynamically control the slew rate of the output buffer in each of the source drivers.

19 Claims, 13 Drawing Sheets

(56) References Cited

U.S. PATENT DOCUMENTS

| | | | | |
|---|---|---|---|---|
| 2015/0130851 | A1* | 5/2015 | Jeong | G09G 3/20 345/690 |
| 2016/0093270 | A1* | 3/2016 | Lee | G09G 3/3688 345/690 |
| 2016/0275897 | A1* | 9/2016 | Lin | G09G 3/3688 |
| 2018/0144706 | A1* | 5/2018 | Cho | G09G 3/2081 |

* cited by examiner

FIG. 3B

| Largest Mean Deviation Value/ Largest Deviation Value | IBIAS |
|---|---|
| 0 ~ 63 | 5 |
| 64 ~ 127 | 6 |
| 128 ~ 190 | 7 |
| 191 ~ 255 | 8 |

FIG. 3C

| Value of Sub-pixel Data Held in Data Latch | Interval Number |
|---|---|
| 0 ~ 63 | 1 |
| 64 ~ 127 | 2 |
| 128 ~ 190 | 3 |
| 191 ~ 255 | 4 |

SOURCE DRIVER UNIT FOR A DISPLAY PANEL

CROSS-REFERENCE TO RELATED APPLICATIONS

This application claims the benefit under 35 USC 119(a) of Korean Patent Application No. 10-2017-0040258 filed on Mar. 29, 2017 in the Korean Intellectual Property Office, the entire disclosure of which is incorporated herein by reference for all purposes.

BACKGROUND

1. Field

The following description relates to a source driver unit for a display panel, and more particularly to a technique for controlling a slew rate of output buffers in the source driver unit.

2. Description of Related Art

A "driver circuit" is known as an electronic circuit that provides an electrical signal to a circuit or an electrical load that consumes electric power. Particularly, when the load is a display panel that includes display elements, the driver circuit is connected to the pixels arranged in a matrix via data lines and gate lines (scan lines). The driver circuit connected to each of the data lines is referred to as a source driver and the driver circuit connected to each of the gate lines is referred to as a gate driver. The source driver includes an output buffer for outputting a driving signal for driving a pixel circuit of the display panel. The output buffer typically maintains its slew rate at a relatively high value, for example, in order to ensure that the output of the output buffer can be stably transitioned within a regulation time of a few microseconds. As a result, the power consumption of the output buffer increases and the driver IC generates more heat.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a source driver apparatus for a display panel includes source drivers and a slew rate controller. Each of the source drivers includes a data latch, a decoder, and an output buffer. The data latch is configured to hold sub-pixel data. The decoder is configured to decode the sub-pixel data held in the data latch to provide a driving signal. The output buffer has an adjustable slew rate and is configured to buffer the driving signal to provide a buffered driving signal. The slew rate controller is configured to analyze the sub-pixel data in the data latch in each of the source drivers and dynamically control the slew rate of the output buffer in each of the source drivers.

The data latch in each of the source drivers may be further configured to hold new sub-pixel data once per horizontal scanning interval in response to a timing controller. The slew rate controller may be further configured to: calculate a deviation between a value of the sub-pixel data for a current horizontal scanning interval held in the data latch in each of the source drivers and a value of the sub-pixel data for a next horizontal scanning interval held in the data latch in each of the source drivers, and control the slew rate of the output buffer in each of the source drivers at the next horizontal scanning interval based on at least part of the deviations.

The output buffer in each of the source drivers may be further configured to receive a bias input for dynamically controlling the slew rate. The slew rate controller may be further configured to dynamically control the slew rate by varying the bias input to the output buffer.

The slew rate controller may be further configured to dynamically control the slew rate of the output buffer in each of the source drivers such that larger deviation values result in higher slew rates at the next horizontal scanning interval.

The slew rate controller may be further configured to dynamically control the slew rate such that upon the bias input to the output buffer in each of the source drivers being increased to have a particular value greater than or equal to a predetermined value at the next horizontal scanning interval, the bias input is maintained to have the particular value at subsequent horizontal scanning intervals in a current frame interval.

The data latch in each of the source drivers may be further configured to hold new sub-pixel data once per horizontal scanning interval under the control of a timing controller. The slew rate controller may be further configured to: repeat, during a current frame interval, the operation of calculating a deviation between a value of the sub-pixel data for a current horizontal scanning interval held in the data latch in each of the source drivers and a value of the sub-pixel data for a next horizontal scanning interval held in the respective data latch, and control the slew rate of each of the output buffers at a next frame interval based on at least part of the deviations.

The data latch in each of the source drivers may be further configured to hold new sub-pixel data once per horizontal scanning interval in response to a timing controller. The slew rate controller may be further configured to determine a first interval number of a first interval to which a value of the sub-pixel data for a current horizontal scanning interval held in the data latch in each of the source drivers belongs and a second interval number of a second interval to which a value of the sub-pixel data for a next horizontal scanning interval held in the respective data latch belongs and calculate a difference between the first and second interval numbers. The differences may include differences calculated based on plural pieces of R sub-pixel data, differences calculated based on plural pieces of G sub-pixel data and differences calculated based on plural pieces of B sub-pixel data, the differences calculated based on the plural pieces of R sub-pixel data constitute a first R difference group, the differences calculated based on the plural pieces of G sub-pixel data constitute a first G difference group, and the differences calculated based on the plural pieces of B sub-pixel data constitute a first B difference group.

The slew rate controller may be further configured to: perform histogram analysis on the first R difference group to exclude one or more differences having an occurrence frequency lower than or equal to a predetermined occurrence frequency from the first R difference group to thereby constitute a second R difference group, perform histogram analysis on the first G difference group to exclude one or more differences having an occurrence frequency lower than or equal to the predetermined occurrence frequency from the first G difference group to thereby constitute a second G difference group, and perform histogram analysis on the first B difference group to exclude one or more differences having an occurrence frequency lower than or equal to the predetermined occurrence frequency from the first B difference group to thereby constitute a second B difference group.

The slew rate controller may be further configured to: select a largest difference from each of the second R difference group, the second G difference group and the second B difference group, select a maximum difference from the largest differences, and determine a bias value (IBIAS) for adjusting the slew rate of the output buffer in each of the source drivers at the next horizontal scanning interval using the maximum difference.

The slew rate controller may be further configured to determine the IBIAS such that a larger maximum difference results in a higher IBIAS.

In another general aspect, the source driver apparatus for a display panel includes a slew rate controller and source drivers. Each of the source drivers includes data latches, decoders, a switch, and an output buffer. The data latches are each configured to hold sub-pixel data. The decoders are connected respectively to the data latches, and each of the decoders is configured to decode the sub-pixel data held in the respective data latch to provide a driving signal. The switch is configured to alternately output the driving signals. The output buffer has an adjustable slew rate and is configured to buffer the outputted driving signal to provide a buffered driving signal. The slew rate controller is configured to analyze the sub-pixel data held in the data latches in the source drivers and dynamically control the slew rate of the output buffer in each of the source drivers.

The data latches may be further configured to hold new sub-pixel data once per horizontal scanning interval in response to a timing controller. The slew rate controller may be further configured to: calculate a deviation between values of sub-pixel data for a next horizontal scanning interval held in adjacent data latches during a current horizontal scanning interval, and control the slew rate of the output buffer in each of the source drivers at the next horizontal scanning interval based on at least part of the deviations.

The output buffer in each of the source drivers may be further configured to receive a bias input for adjusting the slew rate of the respective output buffer. The slew rate controller may be further configured to control the slew rate of the output buffer in each of the source drivers by varying the respective bias input to the respective output buffer.

The slew rate controller may be further configured to dynamically control the slew rates of the output buffers in the source drivers such that larger deviation values result in higher slew rates at the next horizontal scanning interval.

The slew rate controller may be further configured to dynamically control the slew rates of the output buffers in the source drivers such that upon the bias input to each of the output buffers being increased to have a particular value greater than or equal to a predetermined value at the next horizontal scanning interval, the bias input to each of the output buffers in the source drivers is maintained to have the particular value at subsequent horizontal scanning intervals in a current frame interval.

Each of the data latches may be further configured to hold new sub-pixel data once per horizontal scanning interval in response to a timing controller.

The slew rate controller may be further configured to: repeat, during a current frame interval, the operation of calculating a deviation between values of sub-pixel data for a next horizontal scanning interval held in adjacent data latches during a current horizontal scanning interval, and control the slew rate of each of the output buffers in the source drivers at a next frame interval based on at least part of the deviations.

Each of the data latches may be further configured to hold new sub-pixel data once per horizontal scanning interval in response to a timing controller. The slew rate controller may be further configured to determine interval numbers of intervals to which values of sub-pixel data for a next horizontal scanning interval held in adjacent data latches during a current horizontal scanning interval belong and calculate a difference between the interval numbers.

The differences may include first differences each calculated based on R sub-pixel data and G sub-pixel data and second differences each calculated based on B sub-pixel data and G' sub-pixel data, the first differences constitute a first R/G difference group, and the second differences constitute a first B/G' difference group.

The slew rate controller may be further configured to: perform histogram analysis on the first R/G difference group to exclude one or more differences having an occurrence frequency lower than or equal to a predetermined occurrence frequency from the first R/G difference group to constitute a second R/G difference group, and perform histogram analysis on the first B/G' difference group to exclude one or more differences having an occurrence frequency lower than or equal to the predetermined occurrence frequency from the first B/G' difference group to thereby constitute a second B/G' difference group.

The slew rate controller may be further configured to: select a largest difference from each of the second R/G difference group and the second B/G' difference group, select a maximum difference from the largest differences, and determine a bias value (IBIAS) for adjusting the slew rate of each of the output buffers at the next horizontal scanning interval using the maximum difference.

The slew rate controller may be further configured to determine the IBIAS such that a larger maximum difference results in a higher IBIAS.

In another general aspect, an apparatus for controlling slew rates of output buffers in source drivers for a display panel includes a data analyzer and a slew rate controller. The data analyzer is configured to analyze image data sequentially inputted to the source drivers to provide an analysis result. The slew rate controller configured to adaptively control the slew rate of the output buffer in each of the source drivers based on the analysis result.

The source drivers may convert the image data into driving signals to the display panel through data lines.

The output buffers may be configured to buffer the driving signals, and the slew rate controller may be further configured to control the slew rates of the output buffers by changing a bias input into each of the output buffers.

The slew rate controller may be further configured to calculate a bias value (IBIAS) for changing the bias input based on statistics of values of the image data.

Other features and aspects will be apparent from the following detailed description, the drawings, and the claims.

BRIEF DESCRIPTION OF THE DRAWINGS

FIG. 3B is a view illustrating intervals to which deviations between values of sub-pixel data held in data latches can belong.

FIG. 3C is a view illustrating a data table for determining the interval number of the intervals to which the values of the sub-pixel data held in the data latches belongs.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
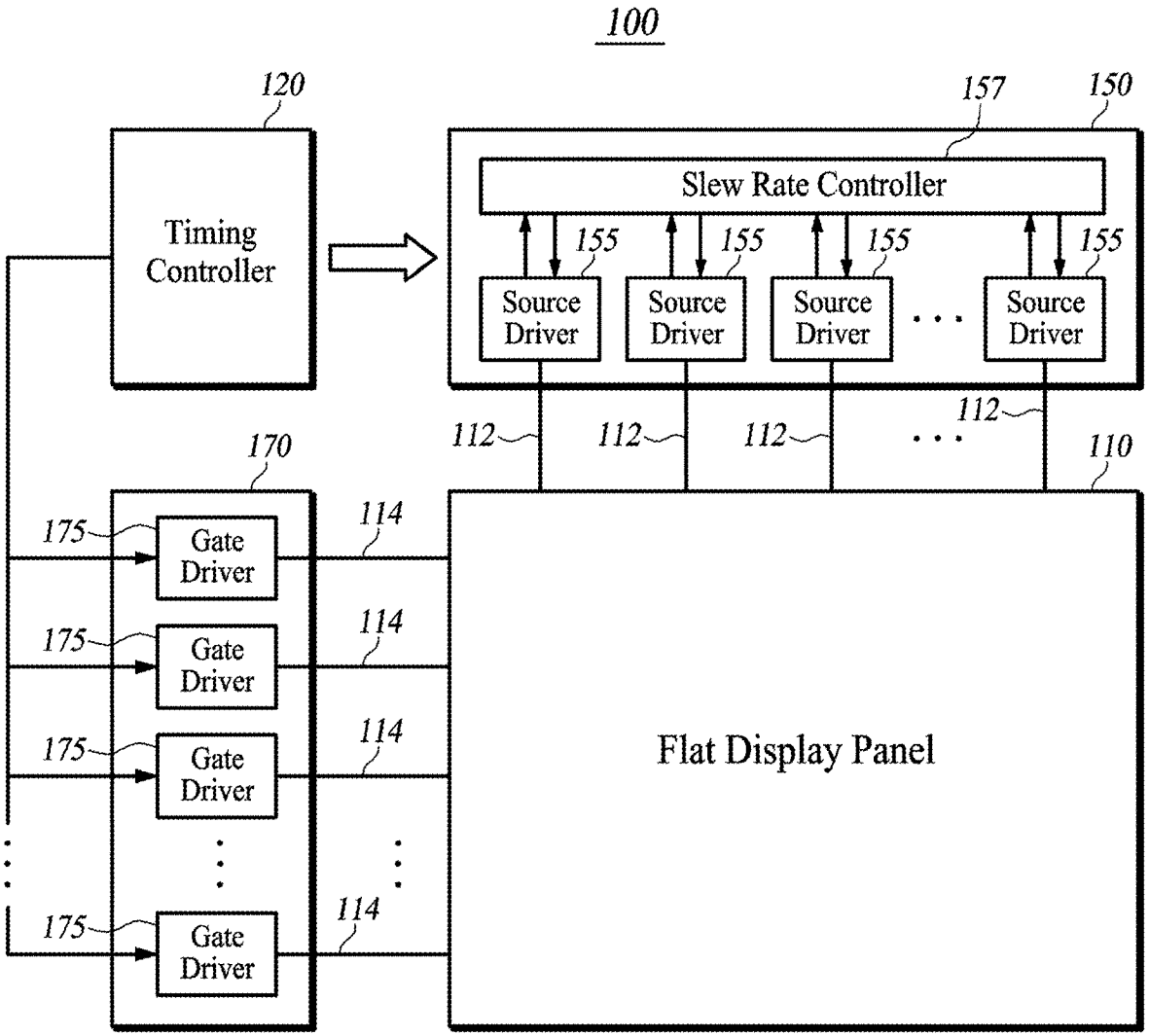
FIG. 1 is a block diagram illustrating an example of a display panel device according to the present application.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

In this disclosure, various examples and implementations are described in further detail to provide a source driver unit for a display panel. Reference will now be made in detail to embodiments, some examples of which are illustrated in the accompanying drawings. The features and advantages of the disclosed technology will become more apparent by referring to the embodiments of the disclosed technology given in conjunction with the attached drawings. However, the disclosed technology is not limited to the embodiments described below but may be embodied in various different ways. Like reference numerals refer to the like elements throughout.

The disclosed examples reduces power consumption and improves heat characteristics of source drivers.

FIG. 1 is a block diagram illustrating an example of a display panel device according to the present application.

As shown in FIG. 1, a display panel device 100 includes a flat display panel 110. In an example, the flat display panel 110 may be a liquid crystal display (LCD) panel. In another example, the flat display panel 110 may be an organic light emitting diode (OLED) panel with a self-luminous structure. Parallel data lines 112 and parallel scan lines 114 crossing the parallel data lines 112 are arranged in the flat display panel 110. A Pixel circuit is arranged at each of the intersections of the data lines 112 and the scan lines 114. Therefore, the flat display panel 110 includes a matrix array of pixel circuits. In an example, the flat display panel 110 is a panel that supports a resolution of a full high definition (HD) including 1080×1920 pixel circuits. Each of the pixel circuits may include sub-pixel circuits. When the flat display panel 110 is a panel of RGB structure, each of the sub-pixel circuits may include an R sub-pixel circuit, a G sub-pixel circuit, and a B sub-pixel circuit. When the flat display panel 110 is a panel of a PenTile structure, each of the sub-pixel circuits may include an R sub-pixel circuit, a G sub-pixel circuit, a B sub-pixel circuit, and a G' sub-pixel circuit. Each of the sub-pixel circuits may include an OLED and a driver transistor connected to the OLED.

The display panel device 100 further includes a timing controller 120, a source driver unit 150, and a gate driver unit 170. The timing controller 120 may be configured to generate image data corresponding to an image to be displayed. Further, the timing controller 120 is configured to generate control signals and timing signals for controlling the source driver unit 150 and the gate driver unit 170. The source driver unit 150 includes source drivers 155. The source drivers 155 is configured to receive the image data from the timing controller 120, to generate driving signals based on the control signals, and to supply the generated driving signals to the flat display panel 110 through the data lines 112 based on the time signals. One frame of the image is displayed on the flat display panel 110 at one frame interval. The one frame interval is divided into horizontal scanning intervals. New sub-pixel data for displaying one line of the image may be provided to the source drivers 115 once per horizontal scanning interval. The source drivers 115 convert the sub-pixel data to the driving signals, and provide the driving signals to the flat display panel 110 through the data lines 112. The source driver unit 150 further includes a slew rate controller 157. The slew rate controller 157 is configured to analyze the image data, which are sequentially inputted to the source drivers 155, to thereby adaptively control a slew rate of an output buffer in each of the source drivers 155 based on the analysis result.

The gate driver unit 170 includes gate drivers 175. The gate drivers 175 receive the control signals from the timing controller 120 and sequentially supply enable signals to the scan lines 114. When an enable signal is supplied to a specific scan line 114, the sub-pixel circuits belonging to the corresponding scan line 114 are activated by the driving signals supplied from the source drivers 155 so that the one line of the image is displayed on the flat display panel 110. Thus, as each of the gate drivers 175 from the upper gate driver 175 to the lower gate driver 175 supplies the enable signal to the flat display panel 110 through a corresponding scan line 114, the corresponding line of the image is displayed accordingly so that the image of a frame can be displayed. Although the timing controller 120, the source driver unit 150, and the gate driver unit 170 are described as separate modules in the illustrated example, it is should be understood that the timing controller 120, the source driver unit 150, and the gate driver unit 170 may be manufactured by being integrated into one display driver IC.

Figure 2:
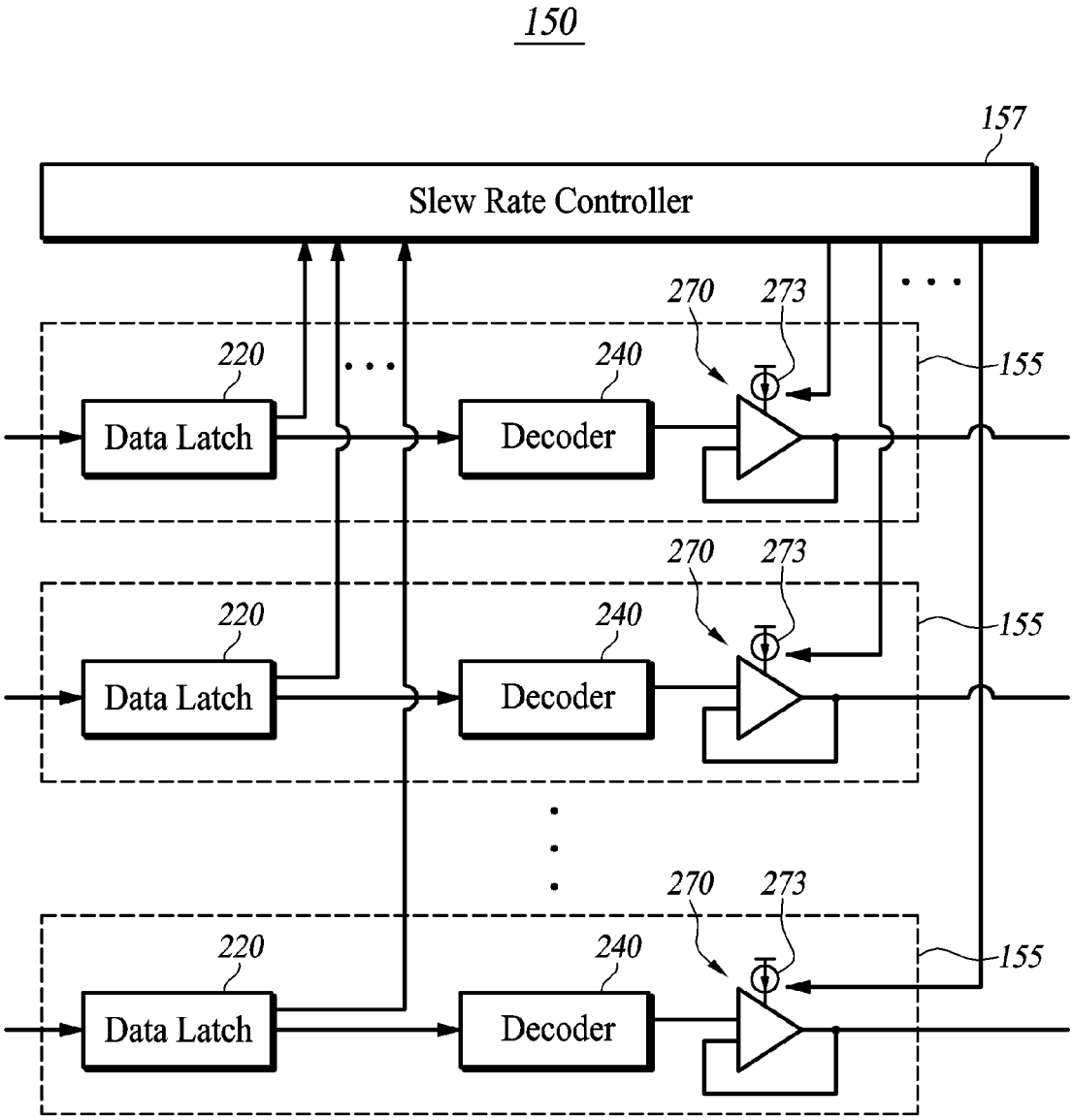
FIG. 2 is a block diagram showing a configuration of a first example of a source driver unit shown in FIG. 1.

FIG. 2 is a block diagram showing a configuration of a first example of the source driver unit shown in FIG. 1.

Referring to FIG. 2, the source driver unit 150 includes the source drivers 155. When the flat display panel 110 is a panel that has RGB structure and supports a resolution of the full HD, since each of the sub-pixel circuits has three sub-pixel circuits for R, G and B and 1080 pieces of the sub-pixel circuits are arranged, the source driver unit 150 may include a total of 3,240 source drivers 155. On the other hand, when the flat display panel 110 is a panel that has a PenTile structure and supports the resolution of the full HD, since each of the sub-pixel circuits has four sub-pixel circuits for R, G, B and G' and 540 pieces of the sub-pixel circuits are arranged, the source driver unit 150 may include a total of 2,160 source drivers 155. Each of the source drivers 155 receives one of R sub-pixel data, G sub-pixel data or B sub-pixel data from the timing controller 120. When the flat display panel 110 is a panel of the RGB structure, for example, the first to fourth source drivers 155 receive the R sub-pixel data, the G sub-pixel data, the B sub-pixel data, and the R sub-pixel data from the timing controller 120, respectively. When the flat display panel 110 is a panel of the PenTile structure, for example, first to fifth source drivers 155 receive the R sub-pixel data, the G sub-pixel data, the B sub-pixel data, G' sub-pixel data and the R sub-pixel data, respectively.

Each of the source drivers 155 includes a data latch 220, a decoder 240 and an output buffer 270. The data latch 220 receives and hold one of the R sub-pixel data, the G sub-pixel data or the B sub-pixel data from the timing controller 120 once per horizontal scanning interval. In an example, the data latch 220 simultaneously holds the sub-pixel data for a current horizontal scanning interval and the sub-pixel data for a next horizontal scanning interval. In an example, the data latch 220 may include a latch configured to hold the sub-pixel data for the current horizontal scanning interval, and a latch configured to hold the sub-pixel data for the next horizontal scanning interval. In an example, the data latch 220 receives and hold the sub-pixel data for the next horizontal scanning interval from the timing controller 120 ahead of the start time of the next horizontal scanning interval by a predetermined time. The decoder 240 is configured to decode the sub-pixel data held in the data latch 220 to thereby provide the driving signal. The decoder 240 may include a D/A converter that converts the sub-pixel data held in the data latch 220 into an analog signal. In an example, the decoder 240 is configured to provide a gamma-corrected driving signal to compensate for non-linear response characteristics to light of a human vision. The output buffer 270 has an adjustable slew rate and is configured to buffer the driving signal provided from the decoder 240 to output the buffered driving signal. The output buffer 270 is configured to receive a bias input for adjusting the slew rate of the corresponding buffer.

The source driver unit 150 further includes a slew rate controller 157. The slew rate controller 157 is configured to analyze the sub-pixel data held in the data latches 220 to control the slew rate of the output buffers 270 in the source drivers 155. The slew rate controller 157 is configured to control the slew rate of each of the output buffers 270 by changing the bias input of the corresponding buffer. The slew rate controller 157 is configured to calculate a bias value IBIAS for changing the bias input to each of the output buffers 270 based on statistics of values of the sub-pixel data held in the data latches 220. The slew rate controller 157 allows the buffered driving signal from each of the output buffers 270 to substantially complete the transition within a regulation slew time ΔT when the horizontal scanning interval is changed, by adaptively changing the bias input to each of the output buffers 270 into the calculated bias value IBIAS. According to the slew rate controller 157 in the example of the present application, the buffered driving signal from each of the output buffers 270 is prevented from transitioning unnecessarily quickly to avoid increased power consumption of the output buffer 270, or the buffered driving signal is prevented from transitioning too late to avoid a degradation of the quality of the image to be displayed.

Figure 3A:
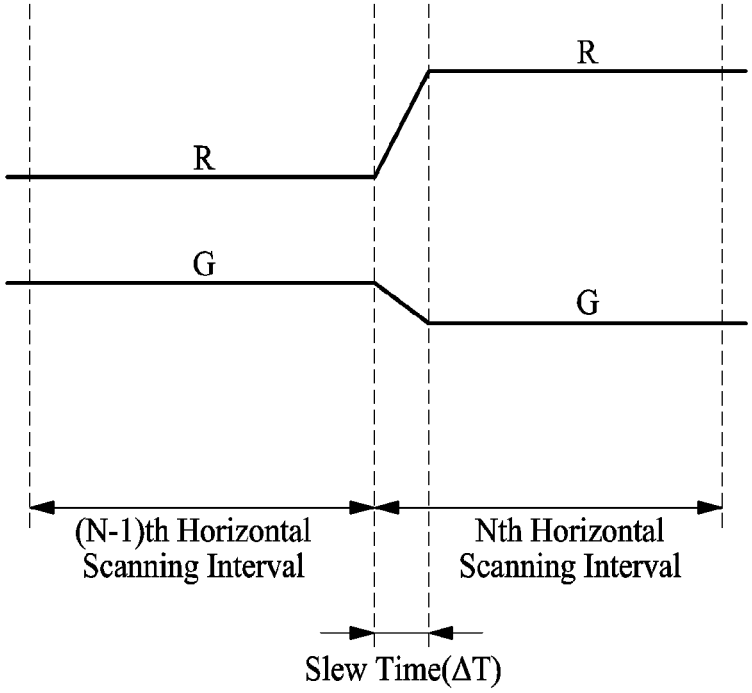
FIG. 3A is a view illustrating transition patterns of the driving signals from output buffers to explain a method of adjusting the slew rate of the output buffers by a slew rate controller of FIG. 2.

FIG. 3A is a view illustrating transition patterns of driving signals from the output buffers to explain a method of adjusting the slew rate of the output buffers by the slew rate controller of FIG. 2.

As shown in FIG. 3A, in the source driver 155 receiving the R sub-pixel data, when a deviation between a value of the R sub-pixel data held in a corresponding data latch 220 at a $(N-1)^{th}$ horizontal scanning interval and a value of the R sub-pixel data held in the corresponding data latch 220 at an $N^{th}$ horizontal scanning interval is large, a corresponding output buffer 270 must be able to output the buffered driving signal that transitions from a low value to high value or vice-versa within the regulation slew time ΔT from the start of the $N^{th}$ horizontal scanning interval. In this case, it is necessary to make the transition of the buffered driving signal within the regulation slew time ΔT by setting the slew rate of the output buffer 270 to a relatively high value. In another example, in the source driver 155 receiving the G sub-pixel data, when a deviation between a value of the G sub-pixel data held in a corresponding data latch 220 at the $(N-1)^{th}$ horizontal scanning interval and a value of the G sub-pixel data held in the corresponding data latch 220 at the $N^{th}$ horizontal scanning interval is insignificant, a corresponding output buffer 270 can provide the buffered driving signal that completes the transition within the regulation slew time ΔT, even if the slew rate is set to a relatively low value. Considering this, the slew rate controller 157 according to the example of the present application is configured to dynamically adjust the slew rate of the output buffer 270 in advance to a value suitable for a transition pattern determined to be generated in the future, in the driving signal outputted from the output buffer 270. The slew rate control unit 270 is configured to determine the transition pattern of the driving signal from the output buffer 270 to be generated in the future, based on the statistics of the values of the subpixel data held in the data latches 220.

The calculation of the bias value IBIAS by the slew rate controller 157 is performed in three modes, namely: a line mode, a frame mode and a modified line mode. Hereinafter, the operation of the slew rate controller 157 in each of modes will be described.

Line Mode

In the line mode, the slew rate controller 157 is configured to update the bias value IBIAS for adjusting the slew rate of the output buffer 270 once per line of the image frame. The slew rate controller 157 is configured to calculate the deviation between the value of the sub-pixel data held in each of the data latches 220 for the current horizontal scanning interval and the value of the sub-pixel data held in the corresponding data latch 220 for the next horizontal scanning interval. Further, the slew rate controller 157 is configured to control the slew rate of each of the output buffers 270 at the next horizontal scanning interval based on at least part of the calculated deviations. The slew rate controller 157 is configured to control the slew rate of the output buffers 270 such that the larger a part of the deviations calculated as above is, the higher the slew rate of the corresponding output buffer 270 becomes by increasing the corresponding bias input to each of the output buffers 270 at the next horizontal scanning interval. When the flat display panel 110 is, for example, the panel of the RGB structure, the method of controlling the slew rates of the output buffers 270 in the line mode by the slew rate controller 157 will be described in more detail as follows.

In an example, the slew rate controller 157 is configured to select the largest mean value of the deviations among mean values between the values of the R sub-pixel data, a mean value of the deviations between the values of the G sub-pixel data and a mean value of the deviations between the values of the B sub-pixel data. Further, the slew rate controller 157 is configured to compare the largest mean value of the deviations with threshold values to determine the bias value IBIAS for adjusting the slew rate of the output buffer 270 at the next horizontal scanning interval. In another example, the slew rate controller 157 is configured to count the number of deviations (R deviation group) that are equal to or larger than a predetermined value among the deviations between the values of the R sub-pixel data, the number of deviations (G deviation group) that are equal to or larger than the predetermined value among the deviations between the values of the G sub-pixel data, and the number of deviations (B deviation group) that are equal to or larger than the predetermined value among the deviations between the values of the B sub-pixel data. The slew rate controller 157 may be configured to select a deviation group having the largest number among the R deviation group, the G deviation group and the B deviation group. Further, the slew rate controller 157 may be configured to reselect a maximum deviation from the selected deviation group. In addition, the slew rate controller 157 may be configured to compare the maximum deviation with the threshold values to determine the bias value IBIAS for adjusting the slew rate of the output buffer 270 at the next horizontal scanning interval. For example, when the largest mean value of the deviations/deviation value is larger than a largest threshold value, the slew rate controller 157 adjusts the bias value IBIAS to a maximum value. As another example, when the largest mean value of the deviations/deviation value is smaller than a smallest threshold value, the slew rate controller 157 adjusts the bias value IBIAS to a minimum value. In an example, when the threshold values include three threshold values, the slew rate controller 157 compares the largest mean value of the deviations/deviation value with the three threshold values classifying the largest mean value as belonging to one of four range intervals. Further, the slew rate controller 157 determines the bias value IBIAS based on the classified result. When it is assumed that a range of values is divided into four intervals and the range of the values can be taken by the deviations between the output values which can be outputted from the output buffers 270 at the $(N-1)^{th}$ horizontal scanning interval and the output values which can be outputted from the output buffer 270 at the $N^{th}$ horizontal scanning interval, the three threshold values are values corresponding to three values that compartmentalizes the four intervals. For example, as shown in FIG. 3B, the four intervals to which the deviations in the values of the sub-pixel data held in the data latch 220 can belong is an interval of 0 to 63, an interval of 64 to 127, an interval of 128 to 190 and an interval of 191 to 255. These intervals correspond to the four intervals to which the deviations in the output values of the output buffer 270 can belong. The above-described intervals and the threshold value(s) are determined based on an analog output value of the output buffer 270. In the illustrated example, the three thresholds may be 63, 127, and 190, respectively. According to the illustrated example, the slew rate controller 157 determines the bias value IBIAS as 5 when the largest mean value of the deviations/deviation value is 53. As another example, the slew rate controller 157 determines the bias value IBIAS as 7 when the largest mean value of the deviations/deviation value is 146.

In another example, the slew rate controller 157 is configured to determine the interval number of a first interval to which a value of the sub-pixel data held in each of the data latches 220 for the current horizontal scanning interval belongs, and the interval number of a second interval to which a value of the sub-pixel data held in the respective data latch belongs, with reference to the data table as shown in FIG. 3C. For example, when a value of the R sub-pixel data held in the data latch 220 for the current horizontal scanning interval is 147 and a value of the R sub-pixel data held in the corresponding data latch 220 for the next horizontal scanning interval is 55, the interval number of the first interval is 3 and the interval number of the second interval is 1. The slew rate controller 157 is configured to calculate the deviation between the interval number of the first interval and the interval number of the second interval. In the case of the above example, the slew rate controller 157 calculates the deviation as 2. The deviations calculated by the slew rate controller 157 includes the deviations (first R deviation group) which are calculated based on the R sub-pixel data, the deviations which are calculated based on the G sub-pixel data, and the deviations (first B deviation group) which are calculated based on the B sub-pixel data. The slew rate controller 157 may be configured to perform a histogram analysis on the first R deviation group to thereby constitute a second R deviation group by excluding at least one deviation having an occurrence frequency lower than or equal to a predetermined occurrence frequency from the first R deviation group. The slew rate controller 157 may be further configured to perform the histogram analysis on the first G deviation group to thereby constitute a second G deviation group by excluding at least one deviation having the occurrence frequency lower than or equal to the predetermined occurrence frequency from the first G deviation group. The slew rate controller 157 may be further configured to perform the histogram analysis on the first B deviation group to thereby constitute a second B deviation group by excluding at least one deviation having the occurrence frequency lower than or equal to the predetermined occurrence frequency from the first B deviation group. The slew rate controller 157 selects largest deviations from each of the second R deviation group, the second G deviation group and the second B deviation group, respectively. Further, the slew rate controller 157 reselects a maximum deviation among the selected three deviations. It is also possible to configure the slew rate controller 157 for selecting one maximum deviation from the second R deviation group, the second G deviation group and the second B deviation group. The slew rate controller 157 is configured to determine the bias value IBIAS for adjusting the slew rate of the output buffer 270 using the maximum deviation. In the case of the example shown in FIG. 3C, the slew rate controller 157 determines the bias value IBIAS as 5 when the maximum deviation is 0, determine the bias value IBIAS as 6 when the maximum deviation is 1, determine the bias value IBIAS as 7 when the maximum deviation is 2, and determine the bias value IBIAS as 8 when the maximum deviation is 3.

Figure 4:
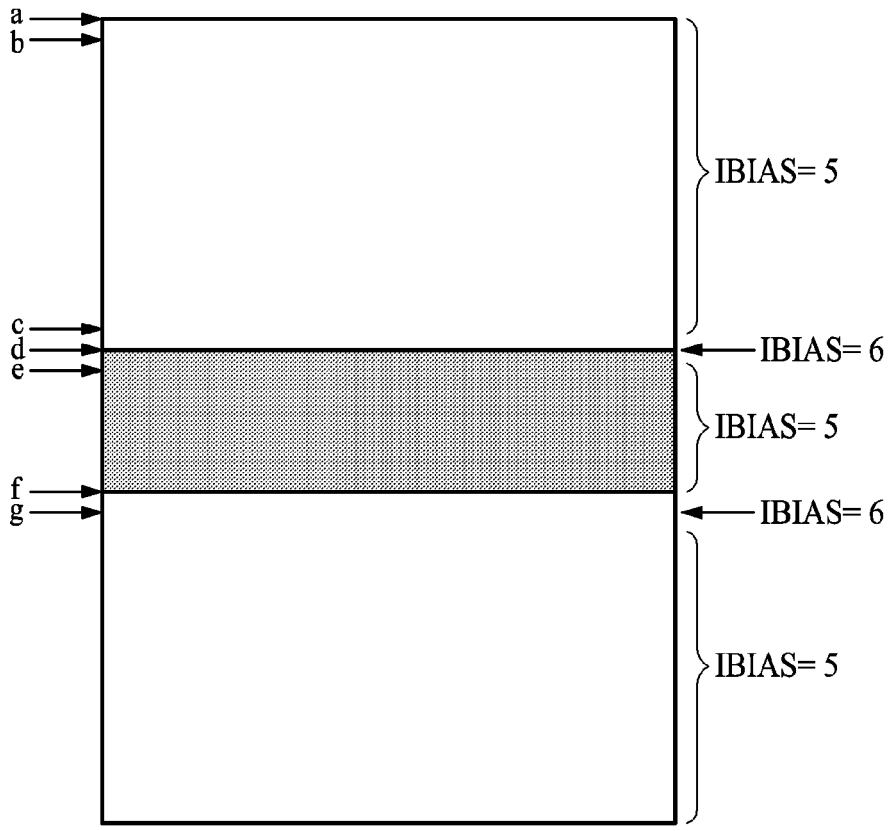
FIG. 4 is a view showing an image frame for explaining the operation in a line mode of the slew rate controller according to the first example.

Referring to FIG. 4, since the pixel values in a second line b are the same as the pixel values in a first line a or the deviations therebetween are almost insignificant, the slew rate controller 157 will determine that the deviations between the values of the sub-pixel data held in the data latches 220 for the horizontal scanning interval corresponding to the line b and the values of the sub-pixel data held in the data latches 220 for the horizontal scanning interval corresponding to the line a are insignificant. Thus, the slew rate controller 157 can determine the bias value IBIAS at the horizontal scanning interval corresponding to the line b as 5 which is a relatively small value. Since the deviations between the pixel values in line d and the pixel values in line c are relatively large, the slew rate controller 157 will determine that the deviations between the values of the sub-pixel data held in the data latches 220 for the horizontal scanning interval corresponding to the line d and the values of the sub-pixel data held in the data latches 220 for the horizontal scanning interval corresponding to the line c are relatively large. Thus, the slew rate controller 157 can determine the bias value IBIAS at the horizontal scanning interval corresponding to the line d as 6, which is a relatively large value. Since the deviations between the pixel values in line e and the pixel values in line d are almost insignificant, the slew rate controller 157 will determine that the deviations between the values of the sub-pixel data held in the data latches 220 for the horizontal scanning interval corresponding to the line e and the values of the sub-pixel data held in the data latches 220 for the horizontal scanning interval corresponding to the lined as insignificant. Thus, the slew rate controller 157 can adjust the bias value IBIAS at the horizontal scanning interval corresponding to the line e to 5 again. In this way, the bias value IBIAS is maintained at 5, and the slew rate controller 157 can again adjust the bias value IBIAS to 6 at the horizontal scanning interval corresponding to a line indicated by g according to the above-described mechanism. The slew rate controller 157 continuously maintains the bias value IBIAS at 5 at the horizontal scanning intervals corresponding to the subsequent lines.

Frame Mode

In the frame mode, the slew rate controller 157 is configured to update the bias value IBIAS for adjusting the slew rate of the output buffer 270 once per image frame. The slew rate controller 157 is configured to repeat the calculation of the deviation between the value of the sub-pixel data held in each of the data latches 220 for the current horizontal scanning interval and the value of the sub-pixel data held in the corresponding data latch 220 for the next horizontal scanning interval, during a current frame interval. Further, the slew rate controller 157 is configured to control the slew rate of each of the output buffers 270 in a next frame interval, based on at least part of the deviations calculated over the current frame interval. The slew rate controller 157 is configured to control the slew rates of the output buffers 270 such that the larger the part of the deviations calculated as above is, the higher the slew rate of the corresponding output buffer 270 becomes by increasing the corresponding bias input to each of the output buffers 270 at the next frame interval. When the flat display panel 110 is, for example, the panel of the RGB structure, a method of controlling the slew rates of the output buffers 270 by the slew rate controller 157 in the frame mode will be described in more detail as follows.

In an example, the slew rate controller 157 is configured to select the largest mean value of the deviations among mean value of the deviations between the values of the R sub-pixel data calculated for the current frame, a mean value of the deviations between the values of the G sub-pixel data calculated for the current frame, and a mean value of the deviations between the values of the B sub-pixel data calculated for the current frame. Further, the slew rate controller 157 is configured to compare the largest mean value of the deviations with the threshold values to determine the bias value IBIAS for adjusting the slew rate of the output buffer 270 at the next frame interval. In another example, the slew rate control unit 157 is configured to count the number of the deviations (R deviation group) that are equal to or larger than a predetermined value among the deviations between the values of the R sub-pixel data calculated for the current frame, the number of the deviations (G deviation group) that are equal to or larger than the predetermined value among the deviations between the values of the G sub-pixel data calculated for the current frame, and the number of the deviations (B deviation group) that are equal to or larger than the predetermined value among the deviations between the values of the B sub-pixel data calculated for the current frame. The slew rate controller 157 is configured to select a deviation group having the largest number among the R deviation group, the G deviation group and the B deviation group, and to reselect a maximum deviation from the selected deviation group. Further, the slew rate controller 157 is configured to compare the maximum deviation with the threshold values to thereby determine the bias value IBIAS for adjusting the slew rate of the output buffer 270 at the next frame interval. Since the method of comparing the largest mean value of the deviations/deviation value with the threshold values to thereby determine the bias value IBIAS for adjusting the slew rate of the output buffer 270 at the next frame interval is the same as the method in the line mode, the detailed description of the method is omitted.

In yet another embodiment, the slew rate controller 157 is configured to repeat, during the current frame interval, an operation determining the interval number of a first interval to which a value of the sub-pixel data held in each of the data latches 220 for the current horizontal scanning interval belongs and the interval number of a second interval to which a value of the sub-pixel data held in a corresponding data latch 220 for the next horizontal scanning interval belongs with reference to the data table as shown in FIG. 3C, and calculating the deviation between the interval number of the first interval and the interval number of the second interval. The deviations calculated by the slew rate controller 157 during the current frame interval may include the deviations (first R deviation group) calculated based on the R sub-pixel data, the deviations (first G deviation group) calculated based on the G sub-pixel data and the deviations (first B deviation group) calculated based on the B sub-pixel data. The slew rate controller 157 may be configured to perform the histogram analysis on the first R deviation group to thereby constitute a second R deviation group by excluding at least one deviation having the occurrence frequency lower than or equal to a predetermined occurrence frequency from the first R deviation group. The slew rate controller 157 may be further configured to perform the histogram analysis on the first G deviation group to thereby constitute a second G deviation group by excluding at least one deviation having the occurrence frequency lower than or equal to the predetermined occurrence frequency from the first G deviation group. The slew rate controller 157 may be further configured to perform the histogram analysis on the first B deviation group to constitute a second B deviation group by excluding at least one deviation having the occurrence frequency lower than or equal to the predetermined occurrence frequency from the first B deviation group. The slew rate controller 157 selects a largest deviation from each of the second R deviation group, the second G deviation group and reselects a maximum deviation among the selected three deviations. The slew rate controller 157 may be configured to determine the bias value IBIAS for adjusting the slew rate of the output buffer 270 using the maximum deviation.

Figure 5:
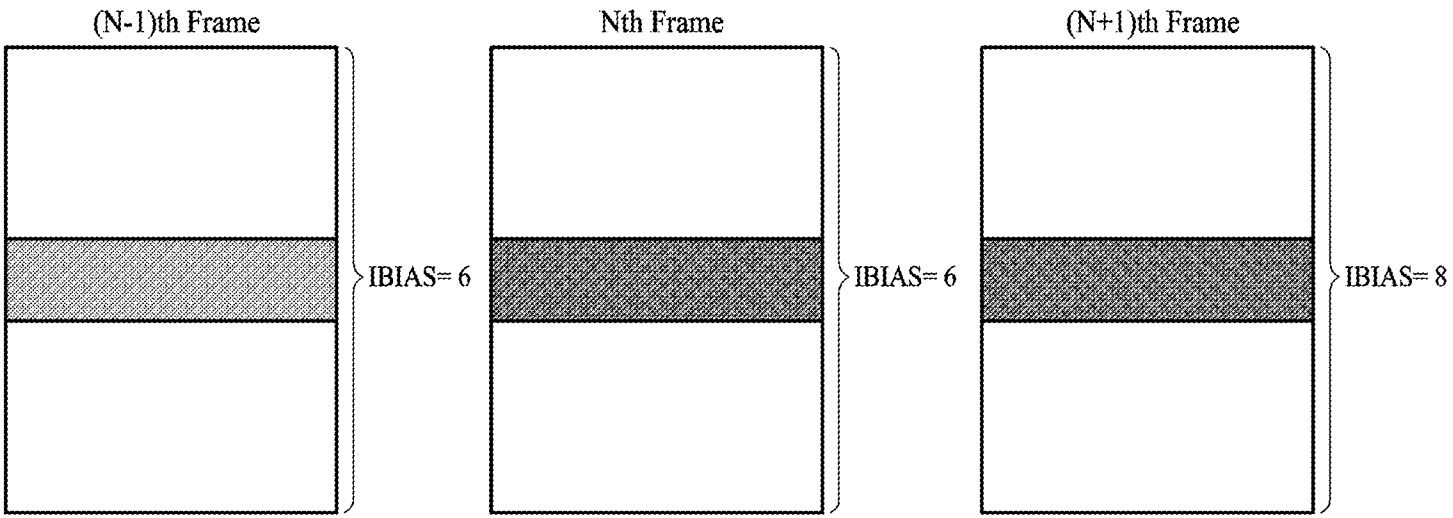
FIG. 5 is a view showing image frames for explaining the operation in a frame mode of the slew rate controller according to the first example.

Referring to FIG. 5, since the bias value IBIAS for the output buffer 270 applied at the $(N-1)^{th}$ frame interval is 6 corresponding to a value determined at the $(N-2)^{th}$ frame interval, and the bias value IBIAS determined over the $(N-1)^{th}$ frame interval is 6 as it is, the bias value IBIAS of 6 is also applied to the output buffer 270 at the $N^{th}$ frame interval. On the other hand, since an image frame at the $N^{th}$ frame interval includes an image detail of the contrast that is somewhat higher than that of the $(N-1)^{th}$ frame, the slew rate controller 157 determines the bias value IBIAS as 8, which is a relatively high value, at the $N^{th}$ frame interval. At the $(N+1)^{th}$ frame interval, the bias value IBIAS of 8 determined at the $N^{th}$ frame interval is applied to the output buffers 270. In the frame mode, although the change of the image details is reflected by a delay of one frame in the determination of the bias value IBIAS, it can be confirmed from the simulation results that the satisfactory level of the image quality and the power reduction effect can be obtained even when the slew rate controller 157 is operated in the frame mode.

Modified Line Mode

In the modified line mode, the slew rate controller 157 is configured to update the bias value IBIAS once per line of the image frame, and to maintain the bias value of a specific value as it is for the other lines of the image frame when the bias value IBIAS reaches the specific value which is equal to or larger than a predetermined value. In the modified line mode, the slew rate controller 157 is configured to operate in accordance with the same mechanism as in the line mode, and to maintain the corresponding bias value IBIAS for each of the output buffers 270 at the other horizontal scanning intervals within the current frame interval to the specific value as it is when increasing the corresponding bias value IBIAS to the specific value equal to or larger than the predetermined value.

Figure 6:
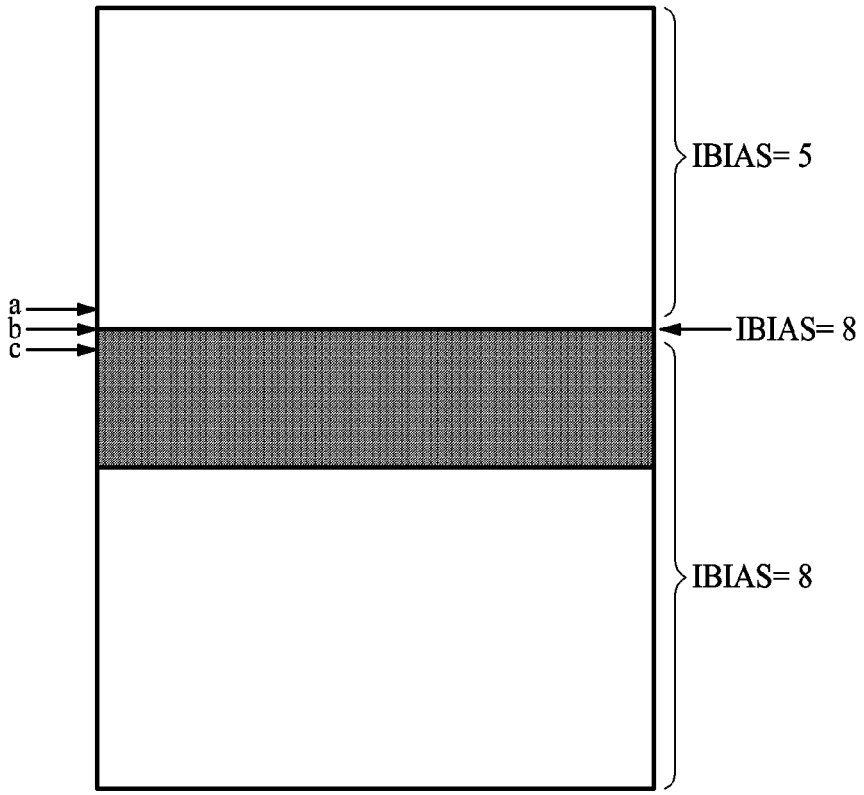
FIG. 6 is a view showing an image frame for explaining the operation in a modified line mode of the slew rate controller according to the first example.

Referring to FIG. 6, the bias value IBIAS is maintained at 5 up to the line a of the image frame by the operation as described in connection with the line mode. However, since the pixel values in the line b have a relatively large difference from the pixel values in the line a, the slew rate controller 157 will determine that the deviations between the values of the sub-pixel data held in the data latches 220 for the horizontal scanning interval corresponding to the line b and the value of the sub-pixel data held in the data latches 220 for the horizontal scanning interval corresponding to the line a are large. Thus, the slew rate controller 157 determines the bias value IBIAS at the horizontal scanning interval corresponding to the line b as 8, which is a large value. As described above, the slew rate controller 157 maintains the bias value IBIAS at the horizontal scanning intervals corresponding to the subsequent lines within the current frame interval at 8 as it is. In the next frame interval, the update of the bias value IBIAS is resumed once per line.

Figure 7:
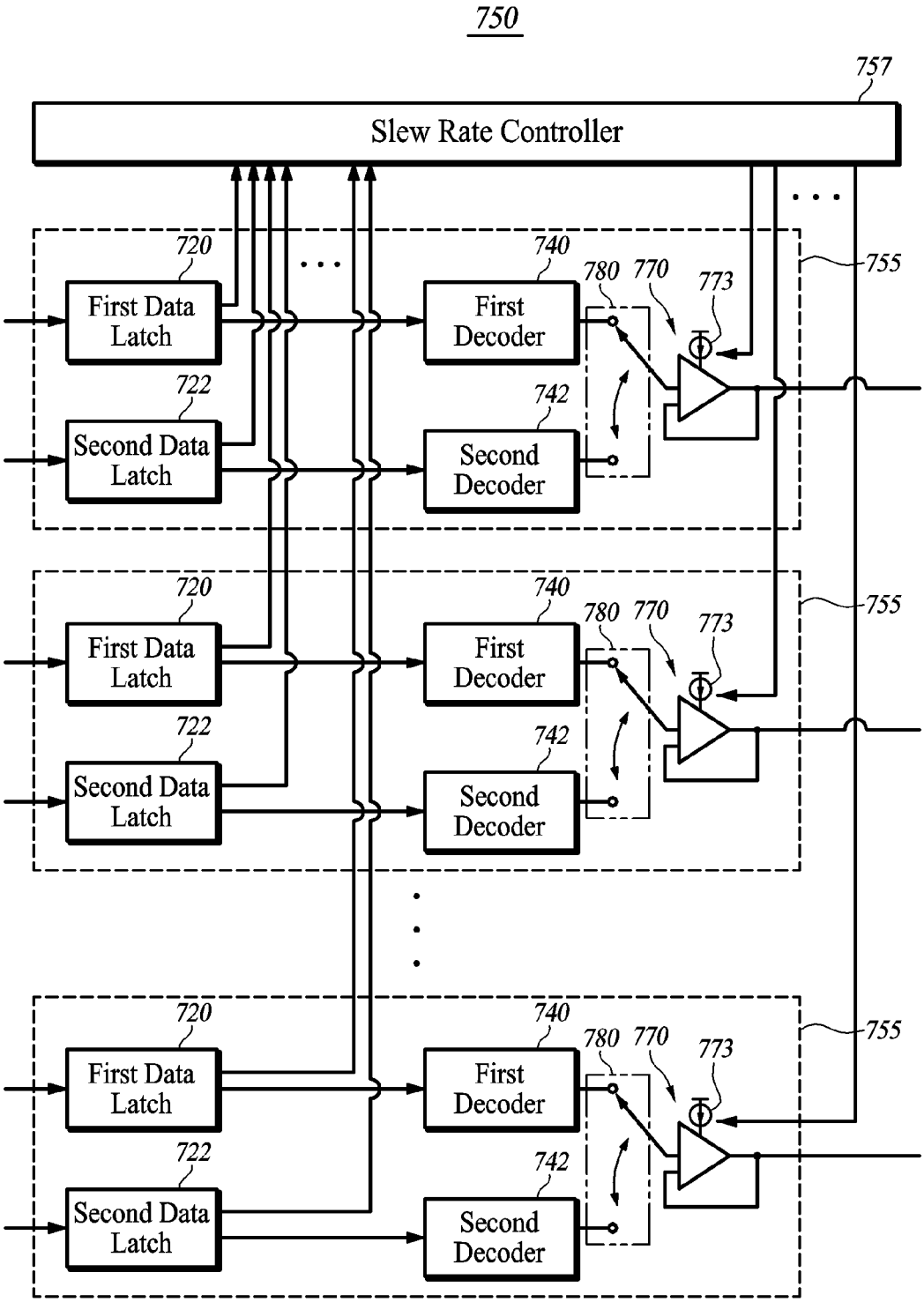
FIG. 7 is a block diagram showing a configuration of a second example of the source driver unit shown in FIG. 1.

FIG. 7 is a block diagram showing a configuration of a second example of the source driver unit shown in FIG. 1.

Referring to FIG. 7, a source driver unit 750 includes source drivers 755. The source drivers 755 shown in FIG. 7 differ from the source drivers 155 shown in FIG. 2 in that the source drivers 755 are configured to receive sub-pixel data from the timing controller 120. This source driver structure depicted in FIG. 7 is a multi-mux structure. Although it is indicated that the source drivers 755 receive two pieces of sub-pixel data from the timing controller 120 in the illustrated example, it is possible that the source drivers 755 are configured to receive the plural pieces of sub-pixel data, such as three, four or the like. Hereinafter, the source drivers of a two-mux structure will be described as an example for convenience.

When the flat display panel 110 is a panel that has a PenTile structure and supports the resolution of the full HD, since each of the sub-pixel circuits has four sub-pixel circuits for R, G, B and G' and 540 pieces of the sub-pixel circuits are arranged, the source driver unit 750 includes a total of 1,080 source drivers. In this case, each of the source drivers 755 is responsible for driving two sub-pixel circuits in such a manner that a first source driver 755 is responsible for driving the R sub-pixel circuit and the G sub-pixel circuit, a second source driver 755 is responsible for driving the B sub-pixel circuit and the G' sub-pixel circuit, and a third source driver 755 is again responsible for driving the R sub-pixel circuit and the G sub-pixel circuit.

Each of the source drivers 755 includes a first data latch 720, a second data latch 722, a first decoder 740, a second decoder 742, a switch 780 and an output buffer 770. Each of the first data latch 720 and the second data latch 722 are configured to receive any one of the R sub-pixel data, the G sub-pixel data, the B sub-pixel data and the G' sub-pixel data and to hold the received sub-pixel data. In an example, each of the first data latch 720 and the second data latch 722 can simultaneously hold the sub-pixel data for the current horizontal scanning interval and the sub-pixel data for the next horizontal scanning interval. In an example, each of the first data latch 720 and the second data latch 722 includes a latch for holding the sub-pixel data for the current horizontal scanning interval and a latch for holding the sub-pixel data for the next horizontal scanning interval. In one example, each of the first data latch 720 and the second data latch 722 is configured to receive and hold the sub-pixel data for the next horizontal scanning interval from the timing controller 120 ahead of the start time of the next horizontal scanning interval by a predetermined time. The first decoder 740 and the second decoder 742 are configured to decode the sub-pixel data held in the first data latch 720 and the second data latch 722, respectively, to thereby provide driving signals. Each of the first decoder 740 and the second decoder 742 may include a D/A converter configured to convert the sub-pixel data held in a corresponding data latch of the first data latch 720 and the second data latch 722 into an analogue signal. In an example, each of the first decoder 740 and the second decoder 742 is configured to provide a gamma-corrected driving signal to compensate for the non-linear response characteristics to the light of the human vision. The switch 780 is configured to alternately output one of the driving signals outputted from the first decoder 740 and the second decoder 742. The switch 780 may be implemented with an electric switch, which is electronically operated. The output buffer 770 has an adjustable slew rate and is configured to buffer the driving signal outputted from the switch 780 to provide the buffered driving signal. By the operation of the switch 780, the output buffer 770 can sequentially provide the driving signal to the two pixel circuits whenever the horizontal scanning interval is changed. The output buffer 770 may be configured to receive a bias input for adjusting the slew rate of the corresponding buffer. In an example, the bias input is implemented with a current source 773 in FIG. 7.

The source driver unit 750 may further include a slew rate controller 757. The slew rate controller 757 may be configured to analyze the sub-pixel data held in the first data latch 720 and the second data latch 722 in each of the source drivers 755 to thereby control the slew rate of the output buffer 770 in each of the source drivers 755. The slew rate controller 757 is configured to control the slew rate of each of the output buffers 770 by changing the bias input of the corresponding buffer. The slew rate controller 757 is configured to calculate the bias value IBIAS for changing the bias input to each of the output buffers 770, based on the statistics of the values of the sub-pixel data held in the first data latch 720 and the second data latch 722 in each of the source drivers 755. The slew rate controller 757 controls so that the switch 780 is operated within the horizontal scanning interval and the buffered driving signal from each of the output buffers 770 starts to the transition at the transition start time corresponding to a start time at which the output is transitioned, and the transition is generally completed within the regulation slew time ΔT, by adaptively changing the bias input to each of the output buffers 770 into the bias value IBIAS, which is calculated once per horizontal scanning interval. As in the first example, according to the slew rate controller 757 in the second example, it is also prevented that the power consumption of the output buffer 770 is increased as the buffered driving signal from each of the output buffers 770 is quickly transited unnecessarily, or the quality of the image to be displayed is degraded as the buffered driving signal is transitioned too late.

Figure 8:
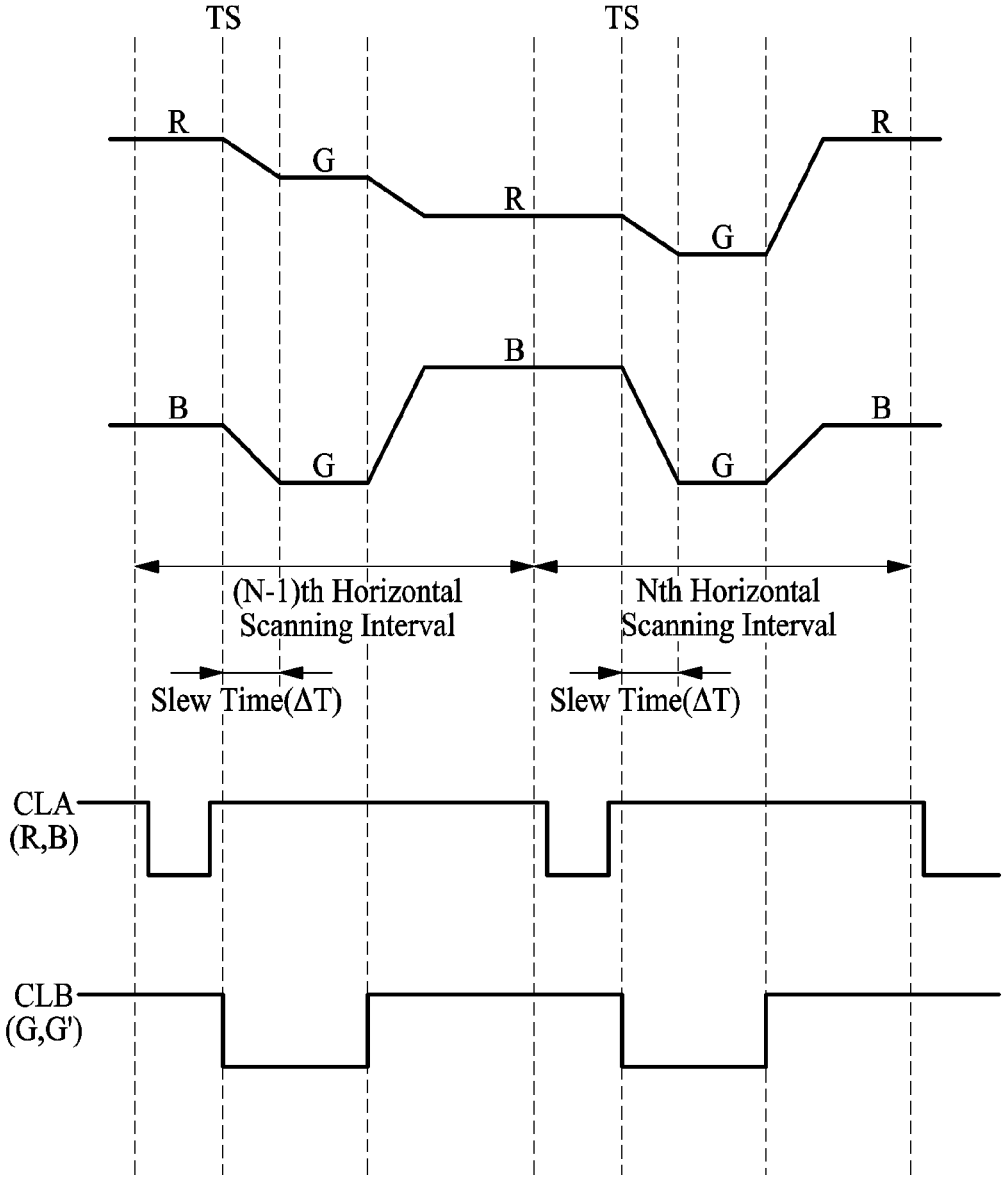
FIG. 8 is a view illustrating transition patterns of the driving signals from output buffers to explain a method of adjusting slew rates of the output buffers by a slew rate controller of FIG. 7.

FIG. 8 is a view illustrating the transition patterns of the driving signals from the output buffers to explain the method of adjusting the slew rates of the output buffers by the slew rate controller of FIG. 7.

As shown in FIG. 8, in the source driver 755 which receives the R sub-pixel data and the G pixel data once per horizontal scanning interval, the buffered driving signal R, which is outputted from the output buffer 770 in synchronization with a clock signal CLA for driving the R/B pixel circuit almost simultaneously with the start of the $(N-1)^{th}$ horizontal scanning interval, is supplied to the R sub-pixel circuit. When a value of the G sub-pixel data held in the second data latch 722 for the $(N-1)^{th}$ horizontal scanning interval is slightly smaller than a value of the R sub-pixel data held in the first data latch 720 for the $(N-1)^{th}$ horizontal scanning interval, the corresponding output buffer 770 outputs the buffered driving signal G which is transitioned to a slightly low value within the regulation slew time ΔT from the transition start time TS. In this case, even if the slew rate of the output buffer 770 is set to the relatively low value, the buffered driving signal can be transitioned within the regulation slew time ΔT. After the transition, the output buffer 770 maintains a saturation state during a predetermined time. During the time that starts from the transition start time TS and the output buffer 770 maintains the saturation state, the buffered driving signal G, which is outputted from the output buffer 770 in synchronization with a clock signal CLB for driving the G/G' pixel circuit, is supplied to the G sub-pixel circuit. As described above, since each of the first data latch 720 and the second data latch 722 receives the sub-pixel data ahead of the start time of the horizontal scanning interval by a predetermined time, the output buffer 770 maintains the saturation state, and then performs the transition to a signal slightly lower than the driving signal G in order to output the driving signal R for the $N^{th}$ horizontal scanning interval before reaching the $N^{th}$ horizontal scanning interval. When the $N^{th}$ horizontal scanning interval is started, the buffered driving signal R, which is outputted from the output buffer 770 in synchronization with the clock signal CLA for driving the R/B pixel circuit, is supplied to the R sub-pixel circuit. When a value of the G sub-pixel data held in the second data latch 722 for the $N^{th}$ horizontal scanning interval is slightly smaller than a value of the R sub-pixel data held in the first data latch 720 for the $N^{th}$ horizontal scanning interval, the corresponding output buffer 770 outputs the buffered driving signal G which is transitioned to a slightly lower value within the regulation slew time ΔT from the transition start time TS. In this case, even if the slew rate of the output buffer 770 is set to the relatively low value, the buffered driving signal can be transitioned within the regulation slew time ΔT. The output buffer 770 then maintains the saturation state during a predetermined time after the transition is completed. During the time that starts from the transition start time TS and the output buffer 770 maintains the saturation state, the buffered driving signal G, which is outputted from the output buffer 770 in synchronization with the clock signal CLB for driving the G/G' pixel circuit, is supplied to the G sub-pixel circuit. The output buffer 770 performs the transition to a signal higher than the driving signal G in order to output the driving signal R for the $(N+1)^{th}$ horizontal scanning interval before reaching the $(N+1)^{th}$ horizontal scanning interval.

In the source driver 755 which receives the B sub-pixel data and the G' pixel data once per horizontal scanning interval, the buffered driving signal B (which is outputted from the output buffer 770 in synchronization with the clock signal CLA for driving the R/B pixel circuit almost simultaneously with the start of the $(N-1)^{th}$ horizontal scanning interval) is supplied to the B sub-pixel circuit. When a value of the G sub-pixel data held in the second data latch 722 for the $(N-1)^{th}$ horizontal scanning interval is slightly smaller than a value of the B sub-pixel data held in the first data latch 720 for the $(N-1)^{th}$ horizontal scanning interval, the corresponding output buffer 770 outputs the buffered driving signal G which is transitioned to a slightly low value within the regulation slew time ΔT from the transition start time TS. In this case, even if the slew rate of the output buffer 770 is set to the relatively low value, the buffered driving signal can be transitioned within the regulation slew time ΔT. After the transition, the output buffer 770 maintains the saturation state during a predetermined time. During the time when the output buffer 770 is maintained at the saturation state after the transition start time TS, the buffered driving signal G', which is outputted from the output buffer 770 in synchronization with a clock signal CLB for driving the G/G' pixel circuit, is supplied to the G' sub-pixel circuit. The output buffer 770 maintains the saturation state during a predetermined time after the transition is completed, and then performs the transition to a signal slightly higher than the driving signal G' in order to output the driving signal B for the $N^{th}$ horizontal scanning interval before reaching the $N^{th}$ horizontal scanning interval. When the $N^{th}$ horizontal scanning interval is started, the buffered driving signal B, which is outputted from the output buffer 770 in synchronization with the clock signal CLA for driving the R/B pixel circuit, is supplied to the B sub-pixel circuit. When a value of the G' sub-pixel data held in the second data latch 722 for the $N^{th}$ horizontal scanning interval is a lot smaller than a value of the B sub-pixel data held in the first data latch 720 for the $N^{th}$ horizontal scanning interval, the corresponding output buffer 770 must be able to output the buffered driving signal G which is transitioned to a low value within the regulation slew time ΔT from the transition start time TS. In this case, the slew rate of the output buffer 770 should be set to a very high value, for example, a maximum value, so that buffered driving signal can be transitioned within the regulation slew time ΔT. The output buffer 770 maintains the saturation state during a predetermined time after the transition is completed. During the time when the output buffer 770 is maintained at the saturation state after the transition start time TS, the buffered driving signal G', which is outputted from the output buffer 770 in synchronization with the clock signal CLB for driving the G/G' pixel circuit, is supplied to the G' sub-pixel circuit. The output buffer 770 performs the transition to a signal slightly higher than the driving signal G' in order to output the driving signal B for the $(N+1)^{th}$ horizontal scanning interval before reaching the $(N+1)^{th}$ horizontal scanning interval.

In the second example, the calculation of the bias value IBIAS by the slew rate controller 757 can be performed in three modes of the line mode, the frame mode and the modified line mode. Hereinafter, the operation of the slew rate controller 757 in each mode will be described.

Line Mode

In the line mode, the slew rate controller 757 is configured to update the bias value IBIAS for adjusting the slew rate of the output buffer 770 once per line of the image frame. The slew rate controller 757 is configured to calculate deviations between the values of the sub-pixel data held in the first data latch 720 and second data latch 722 in each of the source drivers 755 for the next horizontal scanning interval at the current horizontal scanning interval. Further, the slew rate controller 757 is configured to control the slew rate of each of the output buffers 770 at the next horizontal scanning interval, based on, at least, part of the deviations. The slew rate controller 157 is configured to control the slew rate of the output buffers 270 such that the larger the at least part of the deviations calculated as above is, the higher the slew rate of the corresponding output buffer 770 becomes by increasing the corresponding bias input to each of the output buffers 770 at the next horizontal scanning interval. When the flat display panel 110 is, for example, the panel of the PenTile structure, the method in which the slew rate controller 157 controls the slew rates of the output buffers 270 in the line mode will be described in more detail as follows.

In an example, the slew rate controller 757 may be configured to calculate first deviations between values of the R sub-pixel data held in the first data latch 720 and values of G sub-pixel data held in the second data latch 722, for the source drivers 755 which receive the R sub-pixel data and the G sub-pixel data once per horizontal scanning interval. Further, the slew rate controller 757 is configured to calculate second deviations between values of the B sub-pixel data held in the first data latch 720 and values of the G' sub-pixel data held in the second data latch 722, for the source drivers 755 which receive the B sub-pixel data and the G' pixel data once per horizontal scanning interval. The slew rate controller 757 is configured to calculate a mean value of the first deviations and a mean value of the second deviations, and to select a largest mean value of deviations. Further, the slew rate controller 757 is configured to compare the largest mean value of deviations with threshold values to determine the bias value IBIAS for adjusting the slew rate of the output buffer 770 at the next horizontal scanning interval.

In another example, the slew rate controller 757 is configured to count the number of deviations (first deviation group) that are equal to or larger than a predetermined value among the first deviations and the number of deviations (second deviation group) that are equal to or larger than the predetermined value among the second deviations. The slew rate controller 757 is configured to select a deviation group having the largest number between the first deviation group and the second deviation group, and to reselect a maximum deviation from the selected deviation group. Further, the slew rate controller 757 is configured to compare the maximum deviation with the threshold values to thereby determine the bias value IBIAS for adjusting the slew rate of the output buffer 770 at the next horizontal scanning interval. The method of comparing the largest mean value of deviations/deviation value with the threshold values to determine the bias value IBIAS for adjusting the slew rate of the output buffer 770 at the next horizontal scanning interval is the same as described above, the detailed description of the method is omitted.

In yet another example, the slew rate controller 757 determines the interval numbers of intervals to which values of the sub-pixel data held in the first data latch 720 and second data latch 722 in each of source drivers 755 for the next horizontal scanning interval at the current horizontal scanning interval belong, with reference to the data table as shown in FIG. 3C. The slew rate controller 757 is configured to calculate the deviations between the above-mentioned interval numbers. The deviations calculated by the slew rate controller 757 include deviations (first R/G deviation group) which are calculated based on the R sub-pixel data and the G sub-pixel data, and deviations (first B/G' deviation group) which are calculated based on the B sub-pixel data and the G' sub-pixel data. The slew rate controller 757 is configured to perform the histogram analysis on the first R/G deviation group to thereby constitute a second R/G deviation group by excluding at least one deviation having the occurrence frequency lower than or equal to a predetermined occurrence frequency. The slew rate controller 757 is further configured to perform the histogram analysis on the first B/G' deviation group to thereby constitute a second B/G' deviation group by excluding at least one deviation having the occurrence frequency lower than or equal to a predetermined occurrence frequency. The slew rate controller 757 selects a largest deviation from each of the second R/G deviation group and the second B/G' deviation group, and reselects a maximum deviation from the selected deviations. The slew rate controller 757 is configured to determine the bias value IBIAS for adjusting the slew rate of the output buffer 770 using the maximum deviation.

Figure 9:
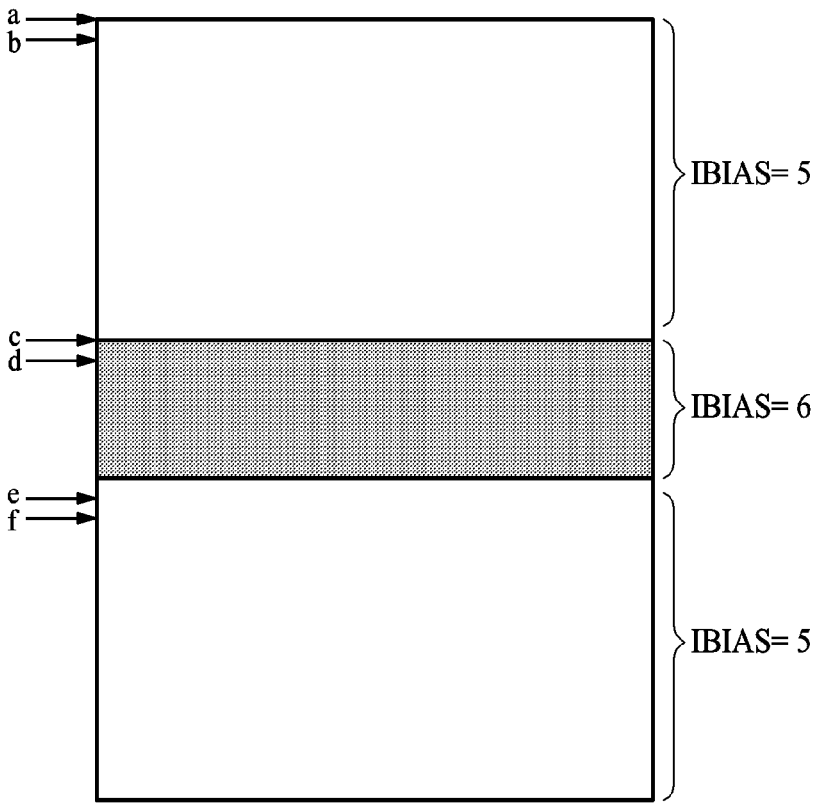
FIG. 9 is a view showing an image frame for explaining the operation in the line mode of the slew rate controller according to the second example.

Referring to FIG. 9, since the deviation between the value of the sub-pixel R and the value of the sub-pixel G and the deviation between the value of the sub-pixel B and the value of the sub-pixel G' are insignificant in the first line a, the slew rate controller 757 will determine that the deviation between the value of the sub-pixel data held in the first data latch 720 and the value of the sub-pixel data held in the second data latch 722 in each of the source drivers 755 for the horizontal scanning interval corresponding to the line a. Thus, the slew rate controller 757 can determine the bias value IBIAS at the horizontal scanning interval corresponding to the line a as 5 which is a relatively small value. In this way, since the bias value IBIAS is maintained at 5, and the deviation between the value of the sub-pixel R and the value of the sub-pixel G and the deviation between the value of the sub-pixel B and the value of the sub-pixel G' are relatively large in a line indicated by c, the slew rate controller 757 will determine that the deviation between the value of the sub-pixel data held in the first data latch 720 and the value of the sub-pixel data held in the second data latch 722 in each of the source drivers 755 for the horizontal scanning interval corresponding to the line c is a relatively large. Thus, the slew rate controller 757 determines the bias value IBIAS at the horizontal scanning interval corresponding to the line c as 6 which is a relatively large value. In this way, since the bias value IBIAS is maintained at 6, and the deviation between the value of the sub-pixel R and the value of the sub-pixel G and the deviation between the value of the sub-pixel B and the value of the sub-pixel G' in a line indicated by e, the slew rate controller 757 will determine that the deviation between the value of the sub-pixel data held in the first data latch 720 and the value of the sub-pixel data held in the second data latch 722 in each of the source drivers 755 for the horizontal scanning interval corresponding to the line e is insignificant. Thus, the slew rate controller 757 again determines the bias value IBIAS at the horizontal scanning interval corresponding to the line e as 5 which is a low value. The slew rate controller 757 continuously maintains the bias value IBIAS at 5 at the horizontal scanning intervals corresponding to the subsequent lines.

Frame Mode

In the frame mode, the slew rate controller 757 is configured to update the bias value IBIAS for adjusting the slew rate of the output buffer 770 once per image frame. In an example, the slew rate controller 757 is configured to calculate the deviation between the values of the sub-pixel data held in the first data latch 720 and second data latch 722 in each of the source drivers 755 within the current frame interval. In another example, the slew rate controller 757 is configured to repeat, during the current frame interval, the operation for determining the interval numbers of the intervals to which the values of the sub-pixel data held in the first data latch 720 and second data latch 722 in each of the source drivers 755 for the next horizontal scanning interval at the current horizontal scanning interval belong, and the operation for calculating the deviation between the determined interval numbers. The slew rate controller 757 is configured to control the slew rate of each of the output buffers 770 at the next frame interval, based on one or more parts of the deviations calculated over the current frame interval as in the case of the first example. The slew rate controller 757 is configured to control the slew rate of the output buffers 770 such that the larger the values of part of the deviations calculated as above is, the higher the slew rate of the corresponding output buffer 770 becomes by increasing the corresponding bias input to each of the output buffers 770 at the next frame interval.

Figure 10:
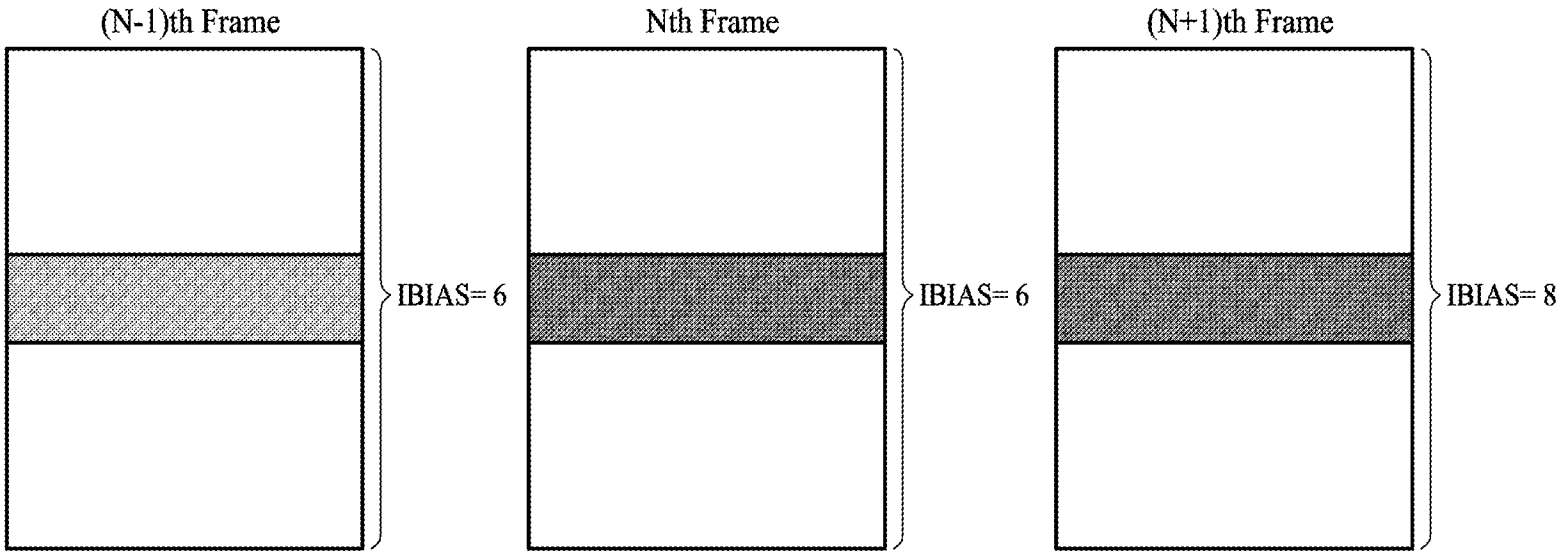
FIG. 10 is a view illustrating image frames for explaining the operation in the frame mode of the slew rate controller according to the second example.

Referring to FIG. 10, since the bias value IBIAS for the output buffer 770 applied at the $(N-1)^{th}$ frame interval is 6 which is a value determined at the $(N-2)^{th}$ frame interval, and the bias value IBIAS determined over the $(N-1)^{th}$ frame interval is 6 as it is, the bias value IBIAS of 6 is applied to the output buffer 770 at the $N^{th}$ frame interval as it is. On the other hand, since an image frame at the $N^{th}$ frame interval includes an image detail of the contrast that is somewhat higher than that of the $(N-1)^{th}$ frame, the slew rate controller 757 determines the bias value IBIAS as 8, which is a somewhat high value, at the $N^{th}$ frame interval. At the $(N+1)^{th}$ frame interval, the bias value IBIAS of 8 determined at the $N^{th}$ frame interval is applied to the output buffers 770.

Modified Line Mode

In the modified line mode, the slew rate controller 757 is configured to update the bias value IBIAS once per line of the image frame, and to maintain the bias value of a specific value as it is for the other lines of the image frame when the bias value IBIAS reaches the specific value, which is equal to or larger than a predetermined value. In the modified line mode, the slew rate controller 757 is configured to operate in accordance with the same mechanism as in the line mode, and to maintain the corresponding bias value IBIAS for each of the output buffers 770 at the other horizontal scanning intervals within the current frame interval at the specific value as it is when increasing the corresponding bias value IBIAS to the specific value equal to or larger than the predetermined value.

Figure 11:
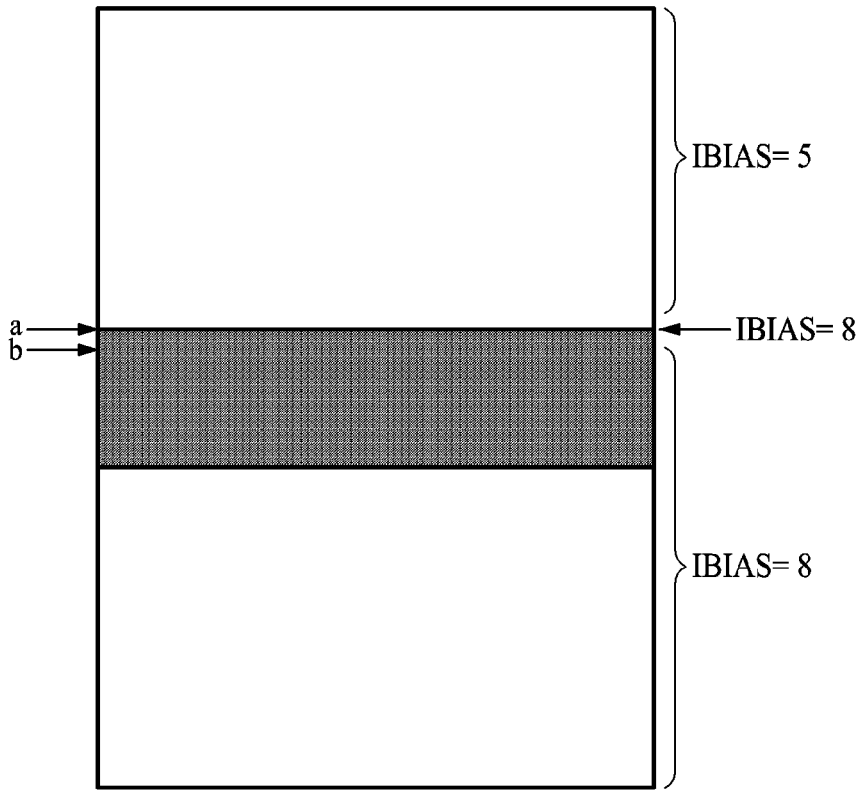
FIG. 11 is a view showing an image frame for explaining the operation in the modified line mode of the slew rate controller according to the second example.

Referring to FIG. 11, the bias value IBIAS is maintained at 5 until the line a of the image frame by the operation described in connection with the line mode. However, the slew rate controller 757 will determine that the deviation between the value of the sub-pixel data held in the first data latch 720 and the value of the sub-pixel data held in the second data latch 722 in each of the source drivers 755 for the horizontal scanning interval corresponding to the line a is large for the reasons described above. Thus, the slew rate controller 757 determines the bias value IBIAS at the horizontal scanning interval corresponding to the line a as 8, which is a relatively large value. As described above, the slew rate controller 757 maintains the bias value IBIAS at the horizontal scanning interval corresponding to the subsequent lines within the current frame interval at 8 as it is. At the next frame interval, the update of the bias value IBIAS is resumed once per line.

The slew rate controllers 157, 757 described above may be implemented with at least one of application specific integrated circuits (ASICs), digital signal processors (DSPs), digital signal processing devices (DSPDs), programmable logic devices (PLDs), field programmable gate arrays (FPGAs), processors, controllers, micro-controllers and microprocessors in terms of hardware. In addition, the slew rate controllers 157, 757 may be implemented with a firmware/software module which performs at least one function or operation and is executable on a hardware platform.

Also, in the examples disclosed herein, the arrangement of the illustrated components may vary depending on an environment or requirements to be implemented. For example, some of the components may be omitted or several components may be integrated and carried out together. In addition, the arrangement order of some of the components and the like may be changed.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A source driver apparatus for a display panel, comprising:

a slew rate controller; and source drivers each comprising:

a data latch configured to hold sub-pixel data;

a decoder configured to decode the sub-pixel data held in the data latch to provide a driving signal; and an output buffer having an adjustable slew rate and configured to buffer the driving signal to provide a buffered driving signal, wherein the slew rate controller is configured to analyze the sub-pixel data in the data latch in each of the source drivers, dynamically control the slew rate of the output buffer based on statistics of value of the sub-pixel data held in the data latch in each of the source drivers, and determine interval numbers of intervals to which values of the sub-pixel data for a current horizontal scanning interval and a next horizontal scanning interval held in respective data latches in the source drivers belong.

2. The apparatus of claim 1, wherein the data latch in each of the source drivers is further configured to hold new sub-pixel data once per horizontal scanning interval in response to a timing controller, and wherein the slew rate controller is further configured to:

calculate a deviation between a value of the sub-pixel data for the current horizontal scanning interval held in the data latch in each of the source drivers and a value of the sub-pixel data for the next horizontal scanning interval held in the data latch in each of the source drivers, and control the slew rate of the output buffer in each of the source drivers at the next horizontal scanning interval based on at least part of the deviations.

3. The apparatus of claim 2, wherein the output buffer in each of the source drivers is further configured to receive the bias input for dynamically controlling the slew rate, and wherein the slew rate controller is further configured to dynamically control the slew rate by varying the bias input to the output buffer.

4. The apparatus of claim 3, wherein the slew rate controller is further configured to dynamically control the slew rate of the output buffer in each of the source drivers such that larger deviation values result in higher slew rates at the next horizontal scanning interval.

5. The apparatus of claim 4, wherein the slew rate controller is further configured to dynamically control the slew rate such that upon the bias input to the output buffer in each of the source drivers being increased to have a particular value greater than or equal to a predetermined value at the next horizontal scanning interval, the bias input is maintained to have the particular value at subsequent horizontal scanning intervals in a current frame interval.

6. The apparatus of claim 1, wherein the data latch in each of the source drivers is further configured to hold new sub-pixel data once per horizontal scanning interval under the control of a timing controller, and wherein the slew rate controller is further configured to:

repeat, during a current frame interval, the operation of calculating a deviation between a value of the sub-pixel data for the current horizontal scanning interval held in the data latch in each of the source drivers and a value of the sub-pixel data for the next horizontal scanning interval held in the respective data latch, and control the slew rate of each of the output buffers at a next frame interval based on at least part of the deviations.

7. The apparatus of claim 1, wherein the data latch in each of the source drivers is further configured to hold new sub-pixel data once per horizontal scanning interval in response to a timing controller, wherein the slew rate controller is further configured to determine a first interval number of a first interval to which a value of the sub-pixel data for the current horizontal scanning interval held in the data latch in each of the source drivers belongs and a second interval number of a second interval to which a value of the sub-pixel data for the next horizontal scanning interval held in the respective data latch belongs and calculate a difference between the first and second interval numbers, wherein the differences comprise differences calculated based on plural pieces of R sub-pixel data, differences calculated based on plural pieces of G sub-pixel data and differences calculated based on plural pieces of B sub-pixel data, the differences calculated based on the plural pieces of R sub-pixel data constitute a first R difference group, the differences calculated based on the plural pieces of G sub-pixel data constitute a first G difference group, and the differences calculated based on the plural pieces of B sub-pixel data constitute a first B difference group, wherein the slew rate controller is further configured to:

perform histogram analysis on the first R difference group to exclude one or more differences having an occurrence frequency lower than or equal to a predetermined occurrence frequency from the first R difference group to thereby constitute a second R difference group, perform histogram analysis on the first G difference group to exclude one or more differences having an occurrence frequency lower than or equal to the predetermined occurrence frequency from the first G difference group to thereby constitute a second G difference group, and perform histogram analysis on the first B difference group to exclude one or more differences having an occurrence frequency lower than or equal to the predetermined occurrence frequency from the first B difference group to thereby constitute a second B difference group, and wherein the slew rate controller is further configured to:

select a largest difference from each of the second R difference group, the second G difference group and the second B difference group, select a maximum difference from the largest differences, and determine a bias value (IBIAS) for adjusting the slew rate of the output buffer in each of the source drivers at the next horizontal scanning interval using the maximum difference.

8. The apparatus of claim 7, wherein the slew rate controller is further configured to determine the BIAS such that a larger maximum difference results in a higher BIAS.

9. A source driver apparatus for a display panel, comprising:

a slew rate controller; and source drivers each comprising:

data latches each being configured to hold sub-pixel data and hold new sub-pixel data once per horizontal scanning interval in response to a timing controller;

decoders connected respectively to the data latches, each of the decoders being configured to decode the sub-pixel data held in the respective data latch to provide a driving signal;

a switch configured to alternately output the driving signals; and an output buffer having an adjustable slew rate and configured to buffer the outputted driving signal to provide a buffered driving signal, wherein the slew rate controller is configured to calculate a deviation between a value of sub-pixel data for a current horizontal scanning interval held in each of the source drivers and a value of the sub-pixel data for a next horizontal scanning interval held in the data latch in each of the source drivers, and control the slew rate of the output buffer in each of the source drivers at the next horizontal scanning interval based on at least part of the deviations.

10. The apparatus of claim 9, wherein the output buffer in each of the source drivers is further configured to receive a bias input for adjusting the slew rate of the respective output buffer, and wherein the slew rate controller is further configured to control the slew rate of the output buffer in each of the source drivers by varying the respective bias input to the respective output buffer.

11. The apparatus of claim 10, wherein the slew rate controller is further configured to dynamically control the slew rates of the output buffers in the source drivers such that larger deviation values result in higher slew rates at the next horizontal scanning interval.

12. The apparatus of claim 11, wherein the slew rate controller is further configured to dynamically control the slew rates of the output buffers in the source drivers such that upon the bias input to each of the output buffers being increased to have a particular value greater than or equal to a predetermined value at the next horizontal scanning interval, the bias input to each of the output buffers in the source drivers is maintained to have the particular value at subsequent horizontal scanning intervals in a current frame interval.

13. The apparatus of claim 9, wherein each of the data latches is further configured to hold new sub-pixel data once per horizontal scanning interval in response to a timing controller, and wherein the slew rate controller is further configured to:

repeat, during a current frame interval, the operation of calculating the deviation between values of sub-pixel data for the next horizontal scanning interval held in the adjacent data latches during the current horizontal scanning interval, and control the slew rate of the output buffers in the source drivers at a next frame interval based on at least part of the deviations.

14. The apparatus of claim 9, wherein the slew rate controller is further configured to determine interval numbers of intervals to which the value of sub-pixel data for the current horizontal scanning interval and the value of the sub-pixel data for the next horizontal scanning interval belong and calculate a difference between the interval numbers, wherein the differences comprise first differences each calculated based on R sub-pixel data and G sub-pixel data and second differences each calculated based on B sub-pixel data and G' sub-pixel data, the first differences constitute a first R/G difference group, and the second differences constitute a first BIG' difference group, wherein the slew rate controller is further configured to:

perform histogram analysis on the first R/G difference group to exclude one or more differences having an occurrence frequency lower than or equal to a predetermined occurrence frequency from the first R/G difference group to constitute a second R/G difference group, and perform histogram analysis on the first BIG' difference group to exclude one or more differences having an occurrence frequency lower than or equal to the predetermined occurrence frequency from the first B/G' difference group to thereby constitute a second B/G' difference group, and wherein the slew rate controller is further configured to:

select a largest difference from each of the second R/G difference group and the second BIG' difference group, select a maximum difference from the largest differences, and determine a bias value (IBIAS) for adjusting the slew rate of each of the output buffers at the next horizontal scanning interval using the maximum difference.

15. The apparatus of claim 14, wherein the slew rate controller is further configured to determine the BIAS such that a larger maximum difference results in a higher BIAS.

16. An apparatus for controlling slew rates of output buffers in source drivers for a display panel, comprising:

a data analyzer configured to analyze image data sequentially inputted to the source drivers to provide an analysis result; and a slew rate controller configured to adaptively respectively control the slew rates of the output buffers based on statistics of values of the image data in the source drivers based on the analysis result and determine interval numbers of intervals to which values of sub-pixel data for a current horizontal scanning interval and a next horizontal scanning interval held in respective data latches in the source drivers belong.

17. The apparatus of claim 16, wherein the source drivers convert the image data into driving signals to the display panel through data lines.

18. The apparatus of claim 17, wherein the output buffers are configured to buffer the driving signals, and wherein the slew rate controller is further configured to control the slew rates of the output buffers by changing the bias input into each of the output buffers.

19. The apparatus of claim 18, wherein the slew rate controller is further configured to calculate a bias value (IBIAS) for changing the bias input based on the statistics of values of the image data.

* * * * *